US005733424A

United States Patent [19]

Dehm et al.

[11] Patent Number: 5,733,424

[45] Date of Patent: Mar. 31, 1998

[54] ELECTRODE WITH PLATE-SHAPED ELECTRODE CARRIER

[75] Inventors: Gerhard Dehm, Freigericht; Martin Pfannschmidt, Heiligenhaus; Wilfried Schug, Viersen; Heinrich Simon, Langenselbold; Edgar Glueck, Floersbachtal, all of Germany

[73] Assignee: Heraeus Elektrochemie GmbH, Hanau, Germany

[21] Appl. No.: 558,829

[22] Filed: Nov. 15, 1995

[30] Foreign Application Priority Data

Nov. 29, 1994 [DE] Germany ..... 44 42 388.8

[51] Int. Cl.[6] ..... C25B 11/00

[52] U.S. Cl. ..... 204/286; 204/280; 204/284; 204/290 R; 204/290 F; 204/288; 204/289

[58] Field of Search ..... 204/284, 286, 204/290 R, 290 F, 279, 280, 288, 289

[56] References Cited

U.S. PATENT DOCUMENTS

| | | | |
|---|---|---|---|
| 4,634,504 | 1/1987 | Bechem et al. | 204/28 |
| 4,642,173 | 2/1987 | Koziol et al. | 204/242 |
| 4,708,888 | 11/1987 | Mitchell et al. | 204/284 |
| 4,855,032 | 8/1989 | Fabian et al. | 204/286 |
| 5,089,109 | 2/1992 | Suganuma et al. | 204/290 R |
| 5,135,633 | 8/1992 | Kotowski et al. | 204/286 |
| 5,531,873 | 7/1996 | Pulliainen et al. | 204/286 |

*Primary Examiner*—Bruce F. Bell
*Attorney, Agent, or Firm*—Felfe & Lynch

[57] ABSTRACT

An electrode for an electrochemical cell used in strip coating systems for continuous metal sheets has a plate-shaped electrode carrier, to which activated electrode components are connected mechanically in a detachable manner. The electrode carrier contains a metal core of material with good electrical conductivity, which, with the exception of the points where the activated electrode parts are connected, is surrounded by a jacketing of valve metal; on the side of the electrode carrier facing the cell wall, a corrosion- resistant plastic body in attached, against which the support means, the spring elements, the positioning elements, or the flow guide elements extending from the cell wall rest, these supports or elements thus being unable to cause any damage to the valve-metal jacketing of the electrode carrier.

8 Claims, 5 Drawing Sheets

ELECTRODE WITH PLATE-SHAPED ELECTRODE CARRIER

BACKGROUND OF THE INVENTION

The invention pertains to an electrode with a plate-shaped electrode carrier for use in an electrolysis cell with a corrosion-resistant support, a spring element, a positioning element, or a flow guide element between the carrier and the cell wall, especially to an electrode of a system for the electroplating of traveling strip material, the system being provided with an electrode carrier which has a core of material with good electrical conductivity and a jacket of valve metal surrounding the core, the core being connected electrically and in a rigidly mechanical manner to external, activated electrode components.

An anode assembly with a plate-shaped anode of valve metal with an active surface for electrolytic processes is known from U.S. Pat. No. 5,135,633. This assembly is especially suitable for the deposition of metal from a metal ion-containing solution onto a substrate, which is connected to a valve metal current conductor. The current is supplied to the electrolysis cell from the outside by way of metals with good electrical conductivity such as copper, aluminum, or steel; the current is conducted to the plate-shaped anodes byway of a carrier, to which the anodes are attached. The carrier is immersed in the electrolyte and is jacketed with valve metal.

Electrodes and anode assemblies of this type are used, for example, in systems for the electroplating of strip, in which the traveling metal strip is connected as the cathode, for example, and a coating of zinc or nickel is applied. A strip coating system and a steel strip coating system such as this are known from U.S. Pat. Nos. 4,634,504 and 4,642,173.

The existing electroplating systems for strip suffer from a problem with the lateral or rear support of the electrode carrier with respect to the inside wall of the housing, the carrier being made of a core of metal with good electrical conductivity and a jacket of valve metal. For example, an electrolyte-resistant system component such as a flow guide plate, a spacer, or a spring element can strike the valve metal jacket and wear it down to such an extent that there is the danger of intrusion by the electrolyte, which can then cause damage to the core of the electrode by corrosion.

SUMMARY OF THE INVENTION

In electrode assemblies such as that described in U.S. Pat. No. 5,135,633, the invention protects the attached jacketing of valve metal from the type of mechanical damage which can be caused by, for example, the fixed and/or spring-mounted support elements or flow guide elements in the electroplating tank. For example, in existing electroplating systems, the inside surface of the cell is provided with a spring-like valve metal plate, which serves to support the anode and to guide the flow of electrolyte and which rests directly on the valve metal jacketing of the electrode.

The invention provides an electrode carrier for an electrode assembly in which the support means, the spring elements, the positioning elements, or the flow guide elements extending from the cell wall touch the valve metal jacketing around the electrode carrier in such a way that, even in the event that the fixed and/or spring-mounted support means or guide plates are made of hard alloy materials, they will be unable to cause any damage to the valve metal jacketing around the electrode carrier.

It is especially advantageous that the invention makes it possible to handle large, heavy electrode carriers in a flexible manner. The use of thermoplastic materials for the plastic components helps to damp vibrations in the electrolyte and thus helps to reduce the wear to which the thinner components such as the valve metal jacketing are subjected. In a preferred embodiment of the invention, fastening elements are designed as part of the elements used to mount the active electrode components, and the plastic bodies are attached to the side of the jacketing of the electrode carrier facing away from the electrode components.

A key advantage of this design is to be seen in that the mounting elements or threaded fasteners which are required in any case to mount the active electrode components serve additionally to hold the plastic bodies in place, so that, in practice, the overall cost for materials and labor is increased only slightly. In addition, it has also been found advantageous that the plastic bodies are easy to remove, if it should become necessary to reactivate the electrode in question.

In a further advantageous embodiment, the threaded mounting elements are provided with recesses, in which fastening elements for the plastic bodies engage; it turns out to be an advantage here that the plastic bodies can also be installed on the electrode carriers of already existing electroplating systems. It is therefore easy to convert such systems so that they can be operated under reduced-wear conditions.

DETAILED DESCRIPTION OF THE PREFERRED EMBODIMENT

Figure 1:
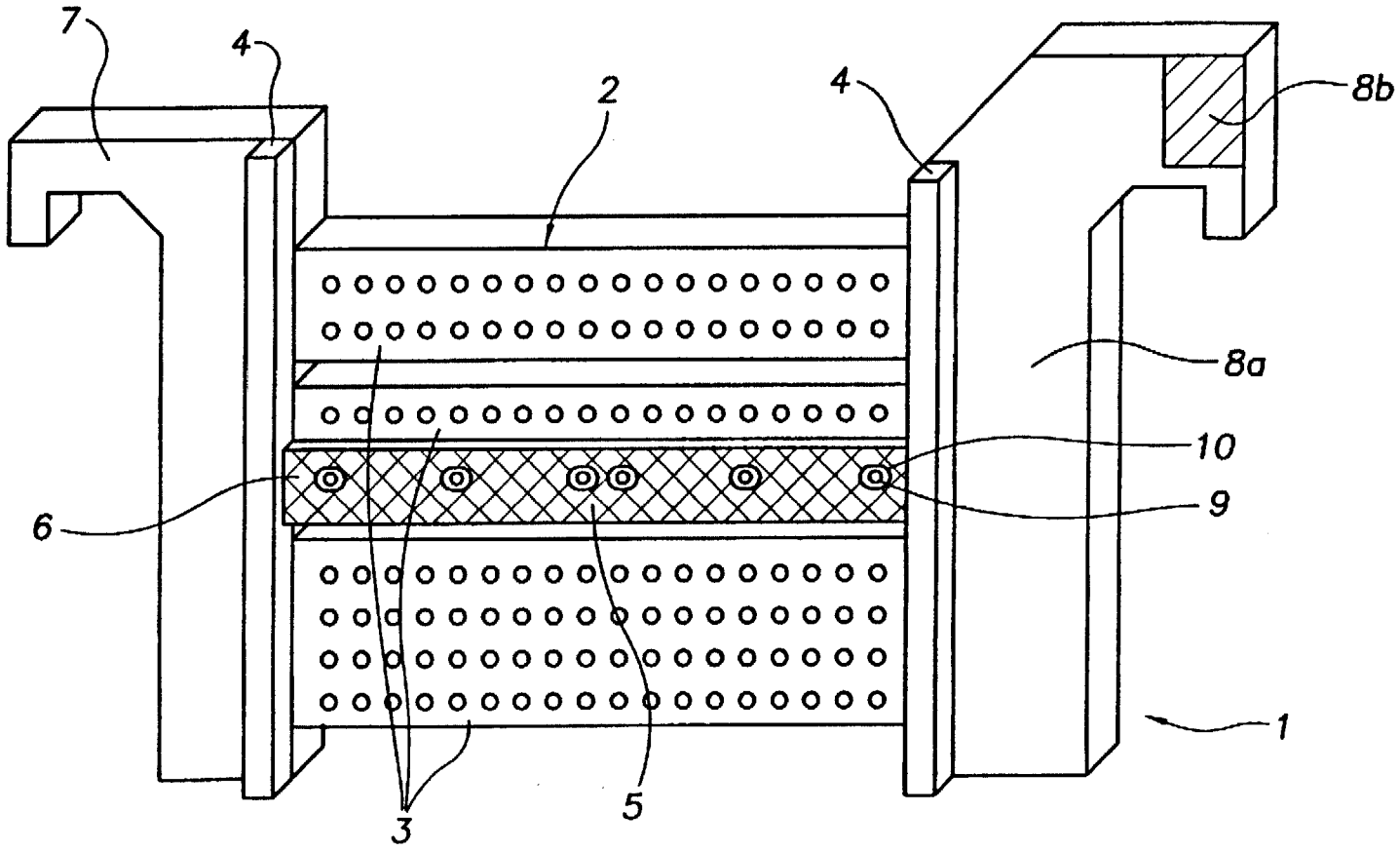
FIG. 1 shows the rear surface of an electrode carrier jacketed with valve metal, to which a plastic body has been attached. The associated parts of the electrode on the front, which cannot be seen here, are used as anodes in a steel strip coating system.

According to FIG. 1, electrode 1 consists of a plate-shaped electrode carrier 2, which is made up of three carrier plates 3; holders 4 on both sides with side brackets 7, **8*a*, by means of which carrier plates 3 are held by their two side edges; and a current feed 8*b*. The electrode also has active electrode components, which are not visible in the figure; mounting elements 5 for the active components, these elements being on the side of electrode carrier 2 facing away from the components; and a plastic body 6, held in place by mounting elements 5 and fastening elements 9, this body being designed in the form of a plastic strip. Electrode carrier 2, i.e., carrier plates 3, consists of a base electrode frame of material with good electrical conductivity and a jacket of valve metal, preferably of titanium sheet, which protects the enclosed metal with good electrical conductivity, such as steel, from corrosion. Inside the valve metal sheathing, a shield gas such as argon or nitrogen is introduced at a slight positive pressure with respect to the out- side atmosphere. The horizontal arms of the two side brackets 7, 8***a* of holder 4 make it possible to hang the carrier inside the container of the electrochemical cell, and a pressurized gas connection is provided so that the space inside the jacketing of carrier plates 3 can be filled with the shield gas. In a preferred embodiment, the current is supplied through hollow conductors, so that a channel for the supply of coolant is provided. The brackets are made of glass fiber-reinforced plastic.

In the back of mounting elements 5 for the active electrode parts, a recess is provided, inside which there is a thread, which allows plastic body 6, designed as a strip, to be fastened in place. The actual fastening of plastic bodies 6 is accomplished by means of fastening screws or elements 9, which are inserted through slots 10 in the plastic body, these slots being large enough to accommodate both the changes in dimensions caused by thermal expansion and production tolerances, as explained in greater detail below on the basis of FIG. 2*a*.

Figure 2A:
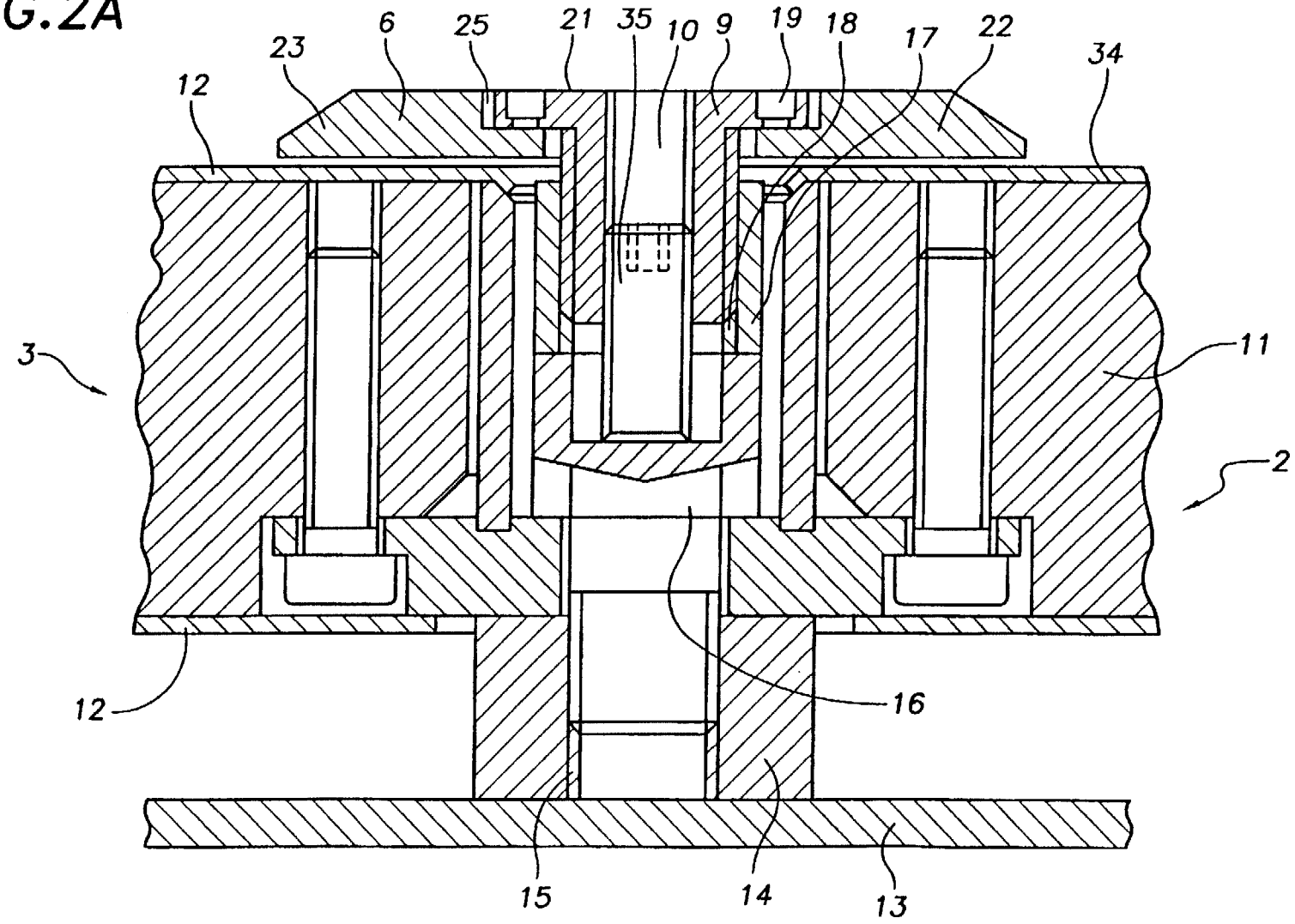
FIG. 2A shows a longitudinal section through part of an electrode carrier together with the plastic body and its fastening means as well as the activated electrode parts attached to the opposite side.
Figure 2B:
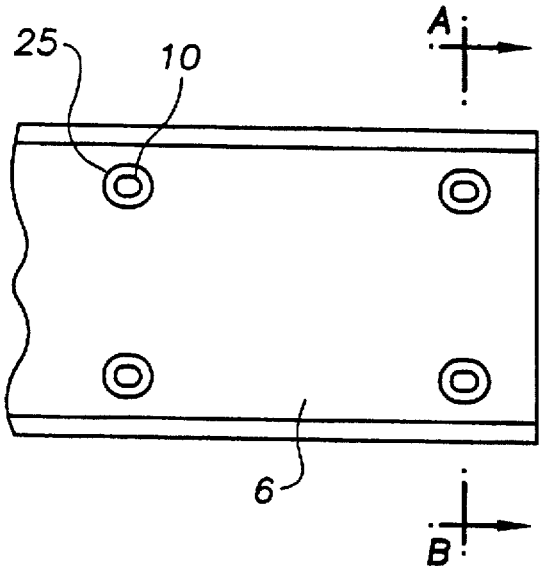
FIG. 2B is a partial plan view of a plastic body with a double row of holes.

According to FIG. 2A, carrier plate 3 of the electrode carrier consists of a base frame 11 of mechanically stable material with good electrical conductivity such as steel and a jacket applied thereon, consisting of a valve metal plate 12, to project the material of the base frame from corrosion by the electrolyte. The basic structure of an electrode assembly such as this is described in U.S. Pat. No. 5,136,633. A contact bushing 14 of valve metal, which has an inside thread 15, is welded to active electrode component 13, shown here schematically, which can thus be fastened by means of an Allen screw 16 to the electrode carrier. A threaded bushing 17 with an internal thread 18 is welded to the head of Allen screw 16. Fastening screw 9, which has the shape of a T in profile, engages in inside thread 18; this screw passes through an opening 10 in plastic body 6 designed as a plastic strip. Two recesses 19 are provided in the head of fastening screw 9 to make it easier to turn and to keep it from turning when making adjustments.

The two lateral flanks 22, 23 of plastic body 6, shown in cross-sectional profile, rest on area 34 of sheath 12 of valve metal, this area being either flat or arched as a result of internal pressure, whereas fastening element 9 engages in internal thread 18 of threaded bushing 17 welded to Allen head screw 16, with the result that wide head 21 of fastening element 9 presses the flange-like recess 25 of plastic body 6, which extends all the way to the center of opening 10, against sheath 12 of electrode carrier 2. The actual fastening of the plastic body is accomplished by using recesses 19 to turn and thus tighten the fastening element, which is designed as a threaded fastener. After the fastening operation, fastening screw 9 itself is then blocked or locked by means of a stud screw 35, which consists of valve metal and which can be turned coaxially with respect to the fastening screw. As a result, additional security is provided against the self-loosening of fastening element 9. On the basis of the cross section according to FIG. 2*a*, it can be seen that, after plastic body 6 has been attached, no corrosion-susceptible parts of base frame 11 are exposed to the outer electrolyte area.

Figure 2C:
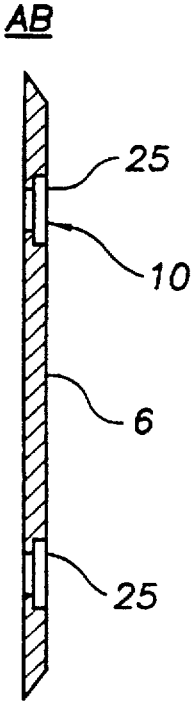
FIG. 2C is an enlarged end section along line AB of FIG. 2B.
Figure 2D:
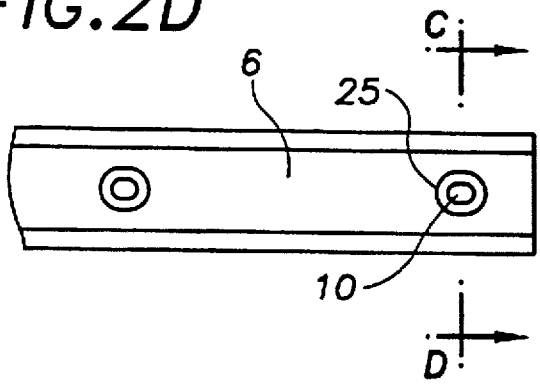
FIG. 2D is a partial plan view of a plastic body with a single row of holes.
Figure 2E:
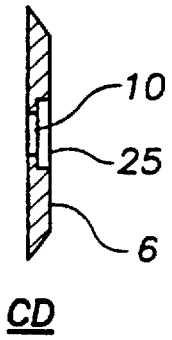
FIG. 2E is an enlarged end section along line CD of FIG. 2D.

The top view and the cross section according to FIGS. 2B–2E show sections of plastic bodies, one with a double row of attachment holes 10 and one with a single row of holes, which, to allow the body to slide in response to thermal expansion, are designed as slots. FIGS. 2C and 2E show the respective cross sections of the plastic strips on an enlarged scale. The design variant with a double row of attachment holes is especially suitable for plastic bodies of large format.

Figure 3:
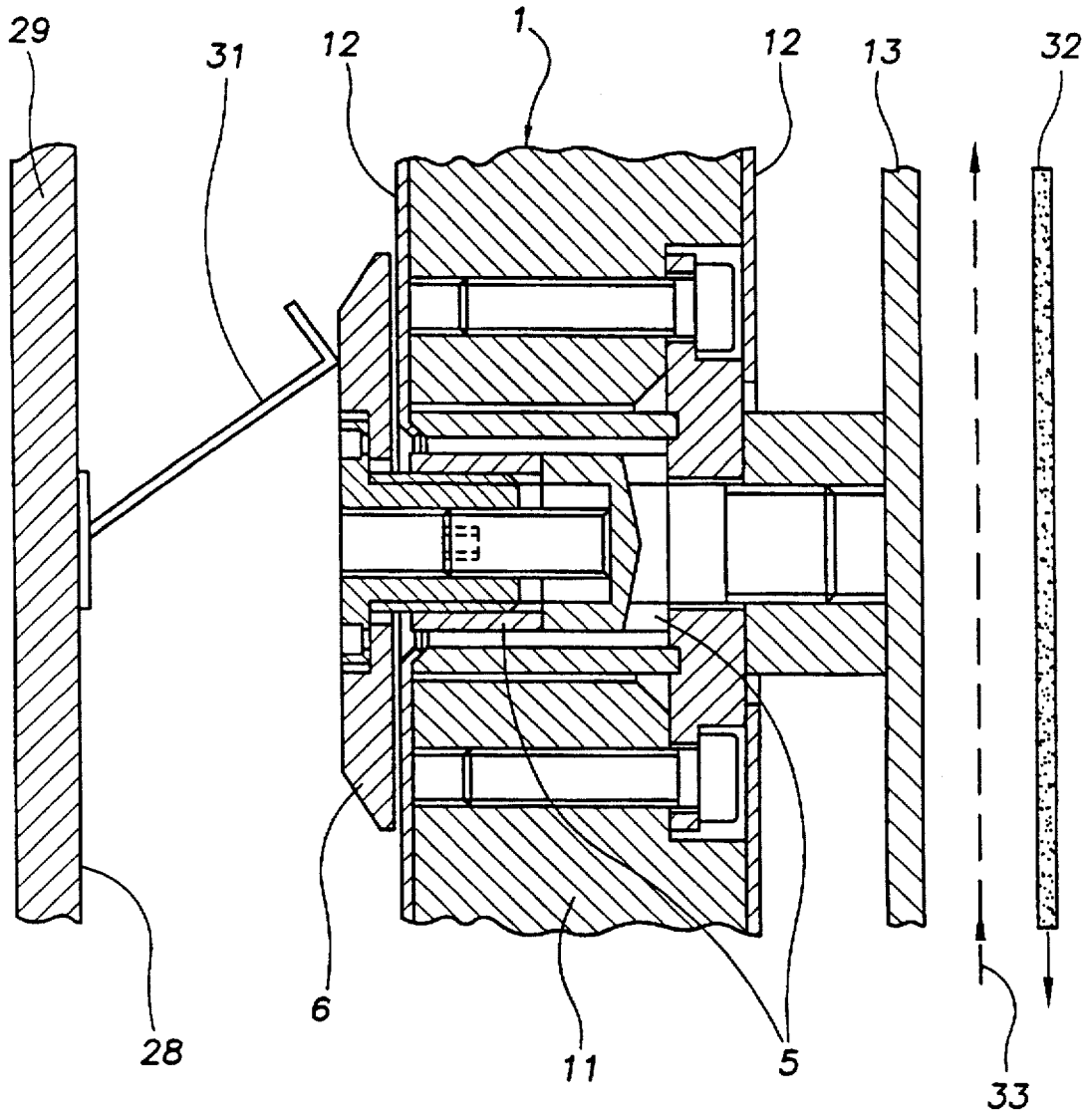
FIG. 3 shows a cross section through part of an electrolysis cell together with a section of the wall of the cell container; with a portion of the electrode, connected as an anode; and with a section of the steel strip passing through container, this strip being connected as a cathode.

FIG. 3 is a schematic diagram in cross section of an electrolysis cell for galvanizing traveling strip material together with the electrode, also shown in cross section, as known from, for example, U.S. Pat. No. 4,634,504. According to FIG. 3, the back of electrode I and thus plastic body 6 are facing wall 28 of the cell for electrolysis operation, only a portion of which is shown; to maintain the proper distance between the electrode and the cell wall and to regulate the flow of electrolyte, a spring element or flow guide element 31 is provided, which extends over the entire width of the electrode and which consists of a corrosion-resistant valve metal alloy, preferably a hard titanium alloy; the spring or flow guide element also serves as a supporting or positioning element. Spring element or circulation guide element 31, which is subjected to vibrational stresses during the strip coating process, is attached to container wall 29 and rests against plastic body 6 on the rear surface of electrode 1. On the side of the electrode facing away from plastic body 6, active electrode components 13 and continuous strip 32 can be seen, the strip being connected to function as a cathode. The electrolyte is supplied in the direction opposite that in which continuous strip 32 is traveling, as indicated by arrow 33. The electrochemical system is therefore formed by active electrode components 13, which are connected as anodes, and by strip 32, which functions as the cathode. The gap with the electrolytic function extends over the distance between strip 32 and the outside surface of active electrode components 13. Steel, aluminum, copper, and their combination with jacketing 12 of titanium produced by explosive plating or by rolling techniques have proven to be especially good materials for base frame 11 of the electrode. The sheathing or jacketing is made of titanium sheet with a thickness in the range of 0.5–2 mm; the activated electrode parts and the associated fastening elements consist of titanium. Polyethylene (PE) and polypropylene (PP) have proven to be especially good materials for the plastic body.

Figure 4:
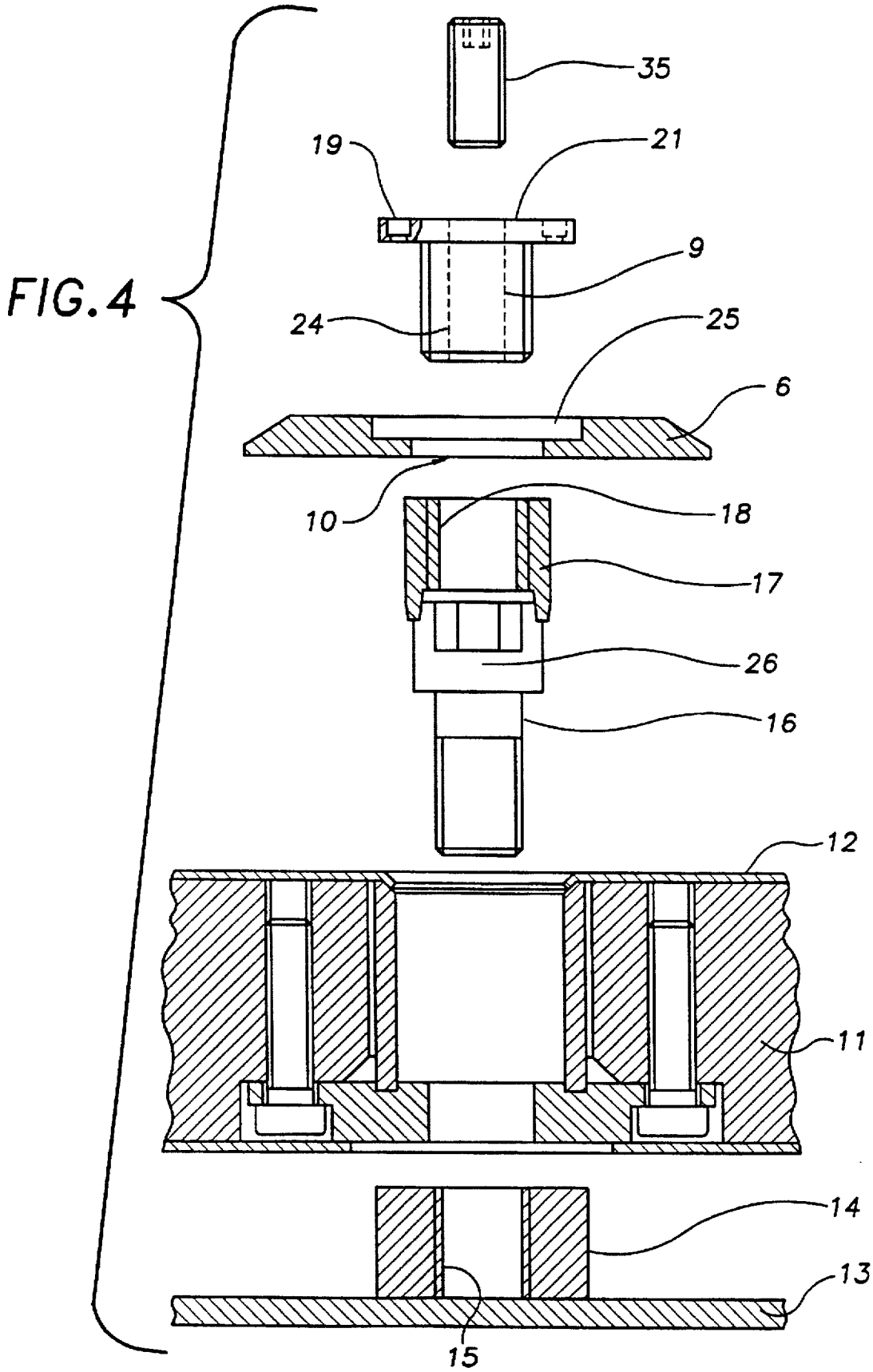
FIG. 4 shows, in cross section, an exploded diagram of the various components required for the fastening of the plastic strip in their relationships to one another.

FIG. 4 is a schematic diagram which shows a partial, exploded view of the system of components for fastening plastic body 6 and active electrode components parts 13; active electrode component 13 is welded in this case to a T-shaped flange 14, which has an internal thread 15, so that an Allen screw serving as fastening element 16 can be screwed into it. A threaded bushing 17 with an internal thread 18 is welded to the head of Allen screw 16. Fastening screw 9, which has a T-shaped profile, can be screwed into the bushing. Plastic body 6 is mounted between the plate-like flange of head 21 of fastening screw 9 and sheathing 12 of the electrode carrier; the flange of the fastening screw rests on a flange-like recess 25 in plastic body 6. To lock the components in place, a stud screw 35 is provided for fastening element 9. During the assembly procedure, this stud screw is turned in internal thread 24 inside the fastening element and thus pressed against the head surface of the Allen screw. As a result, advantage is taken of the locknut effect to lock fastening element 9 permanently in place. The locknut effect is based here on the distorting force acting on thread 24 in the reverse direction. When the head end of the stud screw is tightened against the inside surface or head 26 of Allen screw 16, distorting force is exerted on thread 24 by virtue of the torque present in the assembled state.

What is claimed is:

1. Electrode assembly comprising an electrode carrier plate comprising a metal core having opposed faces with a metal jacket of valve metal on each face, an activated electrode component rigidly connected to one of said faces, a corrosion resistant plastic body mounted to the other of said faces by corrosion resistant mounting means, said plastic body being mounted so that it can slide parallel to said carrier plate to compensate for differences in thermal extension.

2. Electrode assembly as in claim 1 wherein said mounting means comprises a plurality of mounting elements fixed in said plate, each mounting element having a recess therein, and a plurality of fastening elements fixed to respective said mounting elements, each fastening element having a shank received in said recess and a head which retains said plastic body to said carrier plate.

3. Electrode assembly as in claim 2, wherein said recesses are threaded bores, said shanks of said fastening element being threaded for reception in said bores.

4. Electrode assembly as in claim 2 wherein said plastic body is provided with at least one row of holes through which said shanks of said fastening elements are received, said holes being profiled as slots to compensate for thermal expansion.

5. Electrode assembly as in claim 2 wherein said fastening elements are provided with axial holes in the heads thereof, said mounting means further comprising stud screws received in said axial holes, whereby the mounting force of the head against the plastic body can be adjusted.

6. Electrode assembly as in claim 1 wherein said mounting means further comprises means for rigidly connecting said activated electrode component to said carrier plate.

7. Electrode assembly as in claim 1 comprising a plurality of said carrier plates, said plastic body being mounted to at least one of said plates.

8. Electrode assembly as in claim 1 wherein said plastic body is an elongate plastic strip.

* * * * *

UNITED STATES PATENT AND TRADEMARK OFFICE

CERTIFICATE OF CORRECTION

PATENT NO. : 5,733,424

DATED : March 31, 1998

INVENTOR(S) : Dehm et al.

It is certified that error appears in the above-indentified patent and that said Letters Patent is hereby corrected as shown below:

In column 1, line 25, change "byway" to -- by way --.

In column 4, line 66, after "16" insert -- a --.

In column 3, line 31, change "project" to -- protect --.

In column 4, line 12, after "electrode" change "I" to -- 1 --.

In Claim 1, column 5, line 12, change "extension" to -- expansion --.

Signed and Sealed this

Twelfth Day of October, 1999

*Attest:*

Q. TODD DICKINSON

*Attesting Officer*

*Acting Commissioner of Patents and Trademarks*